US008800446B2

(12) United States Patent
Luetke et al.

(10) Patent No.: US 8,800,446 B2
(45) Date of Patent: Aug. 12, 2014

(54) APPARATUS AND PROCESS FOR POSITIONING A CYLINDRICALLY-SHAPED PRINTING ELEMENT

(75) Inventors: Helmut Luetke, Wiesbaden (DE); Ib Vestergaard, Tommerup (DK)

(73) Assignee: E. I. du Pont de Nemours and Company, Wilmington, DE (US)

( * ) Notice: Subject to any disclaimer, the term of this patent is extended or adjusted under 35 U.S.C. 154(b) by 612 days.

(21) Appl. No.: 12/428,735

(22) Filed: Apr. 23, 2009

(65) Prior Publication Data

US 2009/0282999 A1 Nov. 19, 2009

Related U.S. Application Data

(60) Provisional application No. 61/127,777, filed on May 15, 2008.

(51) Int. Cl.

| | |
|---|---|
| ***B41F 13/16*** | (2006.01) |
| ***B41L 47/18*** | (2006.01) |
| ***B41F 17/30*** | (2006.01) |
| ***B41F 17/00*** | (2006.01) |

(52) U.S. Cl.

CPC ..... *B41F 17/30* (2013.01); *B41F 17/006* (2013.01); *Y10S 101/36* (2013.01)

USPC ..... 101/477; 101/481; 101/485; 101/DIG. 36

(58) Field of Classification Search

USPC ..... 101/401.1

See application file for complete search history.

(56) References Cited

U.S. PATENT DOCUMENTS

| | | | | |
|---|---|---|---|---|
| 4,437,403 | A * | 3/1984 | Greiner | 101/248 |
| 4,748,911 | A * | 6/1988 | Kobler | 101/378 |
| 5,279,697 | A | 1/1994 | Peterson et al. | |
| 5,316,524 | A | 5/1994 | Wong | |
| 5,784,961 | A * | 7/1998 | Lorig et al. | 101/375 |
| 5,806,431 | A | 9/1998 | Muth | |
| 6,142,073 | A * | 11/2000 | Zeman et al. | 101/216 |
| 6,797,454 | B1 | 9/2004 | Johnson et al. | |
| 6,941,866 | B2 * | 9/2005 | Schneider et al. | 101/486 |
| 6,998,218 | B2 | 2/2006 | Markhart | |
| 7,041,432 | B2 | 5/2006 | Markhart | |
| 7,044,055 | B2 | 5/2006 | Gotsick et al. | |
| 7,152,529 | B2 | 12/2006 | Gotsick et al. | |
| 7,156,630 | B2 | 1/2007 | Roberts et al. | |
| 7,202,008 | B2 | 4/2007 | Roshelli, Jr. et al. | |
| 7,237,482 | B2 | 7/2007 | Vest et al. | |
| 7,241,124 | B2 | 7/2007 | Roberts et al. | |

(Continued)

FOREIGN PATENT DOCUMENTS

WO WO 2007/012023 A2 1/2007

OTHER PUBLICATIONS

European Search Report dated Mar. 5, 2010, Application #09158993.7 for case GP1218EP/EPA.

*Primary Examiner* — Jill Culler

(57) ABSTRACT

This invention provides an apparatus for treating and a process for positioning a cylindrically-shaped element. The apparatus includes means for supporting the element adapted to contact a first part of an interior surface of the element, the supporting means having an axial length; and means for moving the element along the axial length of the supporting means.

16 Claims, 2 Drawing Sheets

(56) References Cited

U.S. PATENT DOCUMENTS

| | | | | |
|---|---|---|---|---|
| 7,422,840 | B2 | 9/2008 | Dudek et al. | |
| 7,647,868 | B2 * | 1/2010 | Schneider et al. | 101/477 |
| 7,819,060 | B2 * | 10/2010 | Taylor et al. | 101/375 |
| 2006/0104675 | A1 | 5/2006 | Dudek | |
| 2006/0124009 | A1 | 6/2006 | Markhart | |
| 2007/0051262 | A1 | 3/2007 | Gotsick et al. | |
| 2007/0084368 | A1 | 4/2007 | Vest et al. | |
| 2008/0028966 | A1 | 2/2008 | Schneider | |

* cited by examiner

APPARATUS AND PROCESS FOR POSITIONING A CYLINDRICALLY-SHAPED PRINTING ELEMENT

BACKGROUND OF THE INVENTION

1. Field of the Invention

This invention pertains to an apparatus for treating a cylindrically-shaped element, and a process for positioning the cylindrically-shaped element in the apparatus. In particular, the apparatus includes a means for moving the element to a pre-defined position for treatment. The cylindrically-shaped element is moved and positioned for treatment in the apparatus, creating a printing form.

2. Description of Related Art

Flexographic printing plates are well known for relief printing on a variety of substrates which range from soft and easy to deform to relatively hard, such as packaging materials, e.g., cardboard, plastic films, aluminium foils, etc. Flexographic printing plates can be prepared from photosensitive printing elements containing a layer of a photosensitive composition such as those described in U.S. Pat. Nos. 4,323,637 and 4,427,759. Photosensitive elements generally have the layer of the photopolymerizable composition interposed between a support and a cover sheet or multilayer cover element. Upon imagewise exposure of the photosensitive element to actinic radiation, photopolymerization of the photosensitive composition occurs in the exposed areas, thereby curing and rendering insoluble the exposed areas of the layer. Conventionally, the element is treated with a suitable solution to remove areas of the photopolymerizable layer that were not exposed and leaving a printing relief which can be used for flexographic printing.

As an alternative to solution development, a "dry" thermal development process may be used which removes the unexposed areas without the subsequent time-consuming drying step. In a thermal development process, the composition layer, which has been imagewise exposed to actinic radiation, is contacted with an absorbent material at a temperature sufficient to cause the composition in the unexposed portions of the photosensitive layer to soften or melt and flow into an absorbent material. See U.S. Pat. No. 3,060,023 (Burg et al.); U.S. Pat. No. 3,264,103 (Cohen et al.); U.S. Pat. No. 5,015,556 (Martens); U.S. Pat. No. 5,175,072 (Martens); U.S. Pat. No. 5,215,859 (Martens) and U.S. Pat. No. 5,279,697 (Peterson et al.). The exposed portions of the composition layer remain hard, that is, do not soften or melt, at the softening temperature for the unexposed portions. The absorbent material collects the softened un-irradiated material and then is separated and/or removed from the composition layer.

Processors for thermal development of flexographic printing elements are known, for example, from U.S. Pat. No. 5,279,697 and U.S. Pat. No. 6,797,454. In both thermal processing apparatuses an irradiated photosensitive printing element comprising the support and the composition layer is mounted on a drum and a continuous web of absorbent material is passed over a hot roll. The hot roll is urged towards the drum pressing the web against the photosensitive element and forming a nip. Heat is transferred by conduction from the hot roll, through the absorbent web, to the photosensitive element upon contact so the temperature of the composition layer is raised sufficiently to enable the unirradiated portions of the composition layer to liquefy and be absorbed into the absorbent material. The heat transfer might be assisted by IR radiation using an additional IR heater directed to the surface of the composition layer. As the drum and hot roll rotate in contact together, the web is pressed against the photosensitive element to absorb the liquefied unirradiated composition and is then separated from the element. After the unirradiated composition is removed the resulting element has a raised relief surface of hardened areas that is suitable use as a printing plate.

Besides flat or planar photosensitive printing elements, it is also possible to thermally process cylindrically-shaped photosensitive printing elements, such as seamless photopolymer sleeves, or so called plate-on-sleeves. Seamless photopolymer sleeves include at least a continuous or substantially continuous layer of the photopolymerizable composition on a cylindrical support. Plate-on-sleeves include a flat photosensitive printing element mounted onto a cylindrical support.

Development by commercial processors of cylindrical photosensitive printing elements having different diameters can be difficult, time consuming, and expensive. However, an apparatus and process for thermal development of cylindrical photosensitive printing elements is disclosed in the United States Patent Application Publication 2006/0104675 (EP1657593), which overcomes these problems. The process treats a photosensitive element having a cylindrical support and a composition layer adjacent the support opposite an interior surface of the support, the composition layer capable of being partially liquefied. The apparatus includes first means for supporting the photosensitive element by contacting a first part of the interior surface of the cylindrical support; second means for supporting the photosensitive element by contacting a second part of the interior surface of the cylindrical support different from the first part, wherein the cylindrical support has one or more unsupported parts between the first part and the second part; and means for treating an exterior surface of the photosensitive element opposite the support to form a relief surface in the element. The cylindrical photosensitive element is not fully supported during thermal development. It is only partially supported by the first support means and the second support means of the apparatus. The cylindrical photosensitive element is not firmly fixed on a supporting cylinder, such as a drum, during thermal processing, but it is processed in a so-called "loose-fit" mode. In loose-fit mode, the interior surface of the cylindrical support of the photosensitive element is not fully contacted or supported by a supporting cylinder; and only a part or parts of the interior surface are in contact with or supported by a supporting means. In some cases, the hot roll is urged towards the support means pressing the absorbent material against the cylindrically-shaped printing element and forming a nip. Alternatively, the supported photosensitive element is brought into contact to a fixed heated roll by moving the loose-fit structure into a controlled impression.

A problem sometimes arises when the cylindrical photosensitive element has an axial length less than an axial length of the means for supporting the element in the apparatus, in that the position of the photosensitive element on the support means can influence the uniformity of pressure applied to the along the axial length of the photosensitive element at the contact zone of the nip. It is desirable to assure pressure uniformity on the photosensitive element across the nip since non-uniform application of pressure can contribute to the resulting relief structure of the printing form having non-uniform relief depth. It is desirable to avoid differences in pressure at the nip across the axial length of the processed cylindrically-shaped printing element and to create or maintain a symmetrical pressure profile. Also, the mounting cylindrical printing elements having the axial length less than the axial length of the means for supporting oftentimes causes an operator to insert his arm well into an opening of the apparatus. In some cases, the operator may even need to have some scale or ruler, and most probably a special jig, to move the cylindrical printing element sufficiently into the apparatus. There are some issues associated with the mounting of cylindrical printing elements, particularly those printing elements having its axial length less than the axial length of the support means, into the apparatus including: operators might not have long enough arms to move the printing element into the desired position; operators may touch hot surfaces, such as the heated roll or IR heater compartment, within the apparatus; operators may touch sharp edges and corners of the apparatus; and, operators may experience smells or chemical residues that may emit from inside the apparatus while the operator is moving the element. The removal of the cylindrical printing element after processing has the same associated set of problems.

Therefore, there is a need to overcome the problems of related art and to improve existing processors for thermal development of cylindrically-shaped printing elements. In particular there is a need for a solution that ensures a safe and quick positioning of cylindrically-shaped printing elements of different length.

SUMMARY OF THE INVENTION

The present invention provides an apparatus for treating and a process for positioning a cylindrically-shaped element. The apparatus includes means for supporting the element adapted to contact a first part of an interior surface of the element, the supporting means having an axial length; and means for moving the element along the axial length of the supporting means.

In accordance with another aspect of the invention there is provided a process for positioning a cylindrically-shaped element having an interior surface and a side edge, in an apparatus for treating the element. The process includes supporting the element by contacting a first part of an interior surface of the element on a support member having an axial length; engaging a finger into contact with the side edge of the element; and moving the finger on a guide to position the element on the support member.

DETAILED DESCRIPTION OF THE PREFERRED EMBODIMENTS

Figure 1:
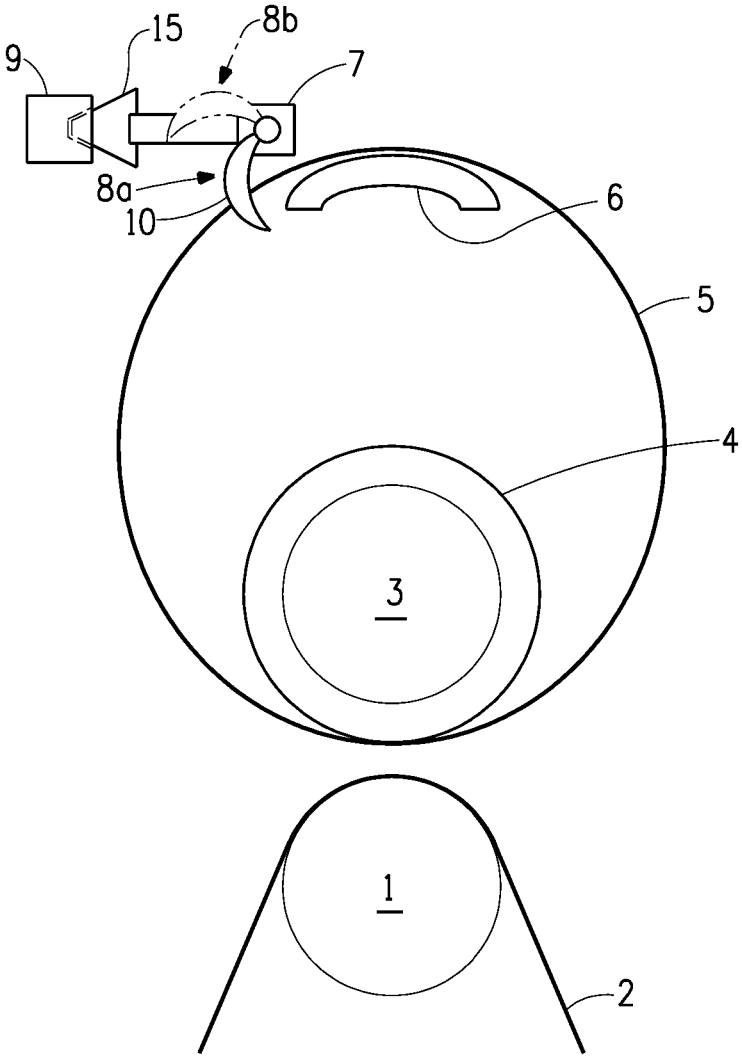
FIG. 1 is a schematic side view of one embodiment of an apparatus for treating a cylindrically-shaped element showing one embodiment of a means for moving the element onto a support means.

Throughout the following detailed description, similar reference characters refer to similar elements in all figures of the drawings.

The present invention is an apparatus for treating a cylindrically-shaped element, and a process for positioning the cylindrically-shaped element. The process locates the cylindrically-shaped element in an apparatus, in particular in the apparatus for treating, to a predetermined position relative to an operational width, (i.e., axial length) of a support member in the apparatus. The cylindrically-shaped element is appropriately positioned in the apparatus to advantageously avoid differences in pressure across an axial length of the cylindrically-shaped element at a contact zone formed at the nip between the element and a contact member. In the present apparatus and process, the cylindrically-shaped element is positioned on a support member to create or maintain a symmetrical pressure profile on the element. In most embodiments, the cylindrically-shaped element is positioned such that the element is axially centered on the support member to assure a symmetrical pressure profile on the element.

In one embodiment the cylindrically-shaped element includes a photosensitive layer, and the apparatus is useful for treating the cylindrically-shaped photosensitive element by thermally developing the element to create a relief structure suitable for printing, such as a flexographic printing form or a letterpress printing form. The apparatus is capable of heating the photosensitive element having a layer of composition capable of being partially liquefied to a temperature sufficient to melt or soften or liquefy at least a portion of the layer for any purpose. In another embodiment the cylindrically-shaped element is a support, and the apparatus is useful for treating the cylindrically-shaped element by forming a layer or modifying an existing layer on an exterior surface of the support to create a cylindrically-shaped printing form. The apparatus is capable of forming the layer of a photosensitive composition or other functional layer on the exterior surface of the support by suitable means including, but not limited to, laminating, extruding, calendering, and coating, to generate a cylindrically-shaped printing form in an uncured or raw state that can then be manipulated by any means to form a printing form having a relief surface. The cylindrically-shaped element may also be referred to herein as the cylindrical element, or simply the element. The cylindrically-shaped element is tubular, i.e., a hollow elongated cylinder. The cylindrically-shaped element has an axial length taken along a longitudinal axis running through the hollow of the element. The axial length of the cylindrically-shaped element may also be referred to herein as a width of the element.

The apparatus and process of the present invention includes a means for moving the cylindrically-shaped element from a first position to a second position to appropriately locate the element for treating and/or to eject the element from the apparatus for easy collection by an operator. The means for moving the element may also be referred to as a device for positioning or a device for moving the element. The present apparatus and process provide an easy way to position the element at a desired location for treatment. In most embodiments, the desired location for treatment of the element is centered on an axial length of a support member or a support means, so that a symmetrical pressure profile across the element occurs during treatment. In other embodiments in which two or more elements are mounted on the support means for treatment, the desirable location may be to position each element at approximately equally spaced intervals on the support means. The use of the moving device in the apparatus also eliminates or reduces the possibility of an operator contacting hot or sharp surfaces within the apparatus during loading and unloading of the element from the apparatus. The use of the moving device also avoids the need for tools and rulers or similar means when positioning elements of small width relative to the axial length of the support.

In a particular embodiment, the moving device is used in an apparatus for thermally developing a cylindrically-shaped photosensitive element in a loose-fit mode. In this embodiment the cylindrically-shaped photosensitive element is a cylindrical printing element that includes a cylindrical support and a composition layer of a photopolymerizable composition on or adjacent the support opposite an interior surface of the support. The apparatus includes a means for supporting the element by contacting a first part of the interior surface of the element, i.e., the support. The apparatus may also include a second means for supporting the element by contacting a second part of the interior surface of the element (or the cylindrical support) different from the first part, wherein the element has one or more unsupported parts between the first part and the second part. The support means and the optional second support means each have an axial length, and a first end. The first support means and the second support means can each be considered a support member.

The cylindrical element that is positioned with the moving device of the present invention is partially supported by at least a first support means and optionally a second support means of the apparatus. The cylindrical element is not firmly fixed on a supporting cylinder, such as a drum or air shaft, during treating, but it is processed in a so-called "loose-fit" mode. In loose-fit mode, the interior surface of the cylindrical support of the element is not fully contacted or supported by a supporting member, e.g., cylinder; and only a part or parts of the interior surface are in contact with or supported by a supporting means. That is, in one embodiment, one part of the interior surface circumference of the cylindrical support is contacted by or supported with the support means, such that the element has one part of the interior surface that is unsupported. That is, in another embodiment, two or more parts of the interior surface circumference of the cylindrical support are contacted by or supported with the support means, such that the element resides about the support means in a band-like fashion. The cylindrical support has between the supported parts one or more parts of the interior surface that are unsupported. This loose fit mode is particularly useful for thermally treating of photosensitive elements in which the cylindrical support is a flexible sleeve and includes a continuous photopolymerizable layer on the sleeve. A suitable apparatus for thermal development of cylindrical printing elements in the loose fit mode is described for example in the United States Patent Application Pub. No. 2006/0104675 (EP1657593). The moving device of the present invention can advantageously be used in the apparatus disclosed in the United States Patent Application Pub. No. 2006/0104675 (EP1657593). It should be understood that the means for supporting the element in the apparatus of the present invention can be the first support means and/or the second support means of the apparatus as disclosed in United States Patent Application Pub. No. 2006/0104675 (EP1657593).

Figure 2:
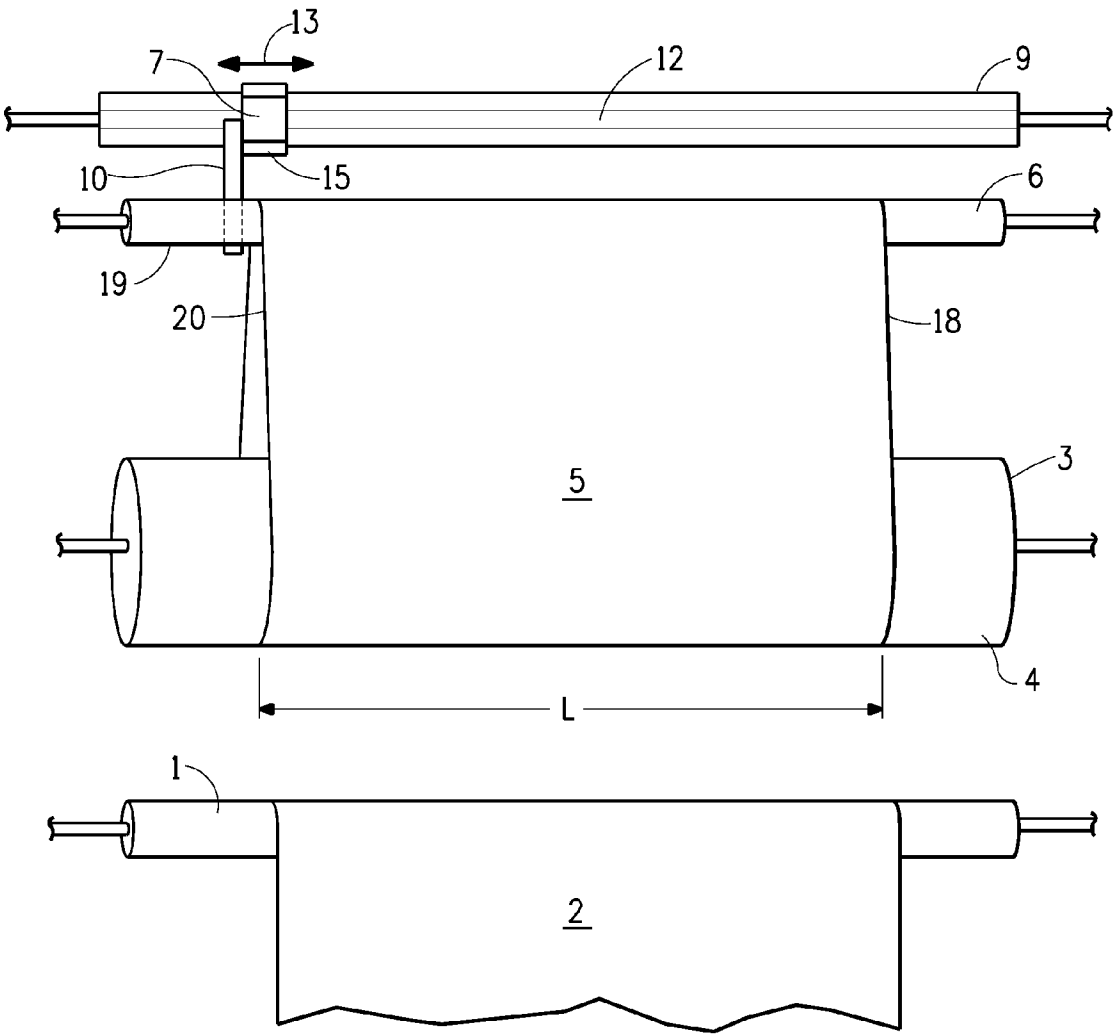
FIG. 2 is a schematic front view of the apparatus showing the moving means axially locating the element on the support means.

FIGS. 1 and 2 show one embodiment of an apparatus for treating the cylindrically-shaped element in the loose-fit mode. The apparatus includes one embodiment of a means for moving the element on a support member. In the embodiment shown, the apparatus thermally develops an embodiment of the cylindrical element 5 in which the element includes a photosensitive layer (not shown) that previously was image-wise exposed. The cylindrical element 5 has an axial length, L, measured between a first end 18 and a second end 20 of the element. The apparatus includes a first means for supporting 3 the cylindrical element by contacting a first part of an interior surface of the support of the cylindrical element, a second means for supporting 6 the cylindrical element by contacting a second part of the interior surface of the support of the cylindrical element different from the first part, and a contact roll 1 as a means for treating an exterior surface of the cylindrical element with a development medium 2. A means for moving the element 5 along the axial length of the second support means 6 includes a means swivelling 7 a finger 10 into and out of engagement with the cylindrical element 5 mounted to a linear positioning and guiding system or guide 9. In the embodiment shown, the means for treating an exterior surface of the cylindrical element 5 is the contact roll 1 that carries a continuous web of a development medium 2 to remove unexposed (i.e., unpolymerized) portions of the photosensitive layer and form a relief structure for use as a printing form. In some embodiments, the contact roll 1 is heated, and may be referred to herein as a hot roll or heated roll. In other embodiments, the contact roll 1 is not heated.

In the embodiment shown, the first means for supporting 3 the cylindrical element 5 is a roller covered with an adapter sleeve 4 having a compressible layer. The roller may be an air-shaft having radial passages for supplying air to an outer circumferential surface of the roller for ease in mounting or demounting the adapter sleeve 4 to and from the shaft. The roller, which may also be referred to as a "format cylinder", is capable of holding the adapter sleeve 4 with a special surface as described in the United States Patent Application Pub. No. 2006/0104675 (EP1657593). Alternate embodiments of the first means for supporting the interior surface of the cylindrical element include a drum, a roller, a plurality of rollers, and a platform member that can be planar or have an arc.

The second means for supporting 6 the interior surface of the cylindrical element has an outer surface having an arcuate shape contacting the second part of the cylindrical support of the element, which may be referred to as an "arc" or an arched platform member. The arc is moveable relative to the first support means 3 to account for supporting elements of various repeat lengths. Alternate embodiments of the second support means 6 are contemplated to include for example, a roller or narrow plate, such that the second means for supporting 6 is not limited to arcuate-shaped support members. The arc has an outer surface that can be treated for low friction by means of a coating based on fluorinated polymers, for example based on a Teflon® coating. Teflon® tape or other methods are for example known to reduce friction. Alternate embodiments of the second means for supporting the interior surface of the cylindrical element include a roller, a plurality of rollers, and a planar platform member.

As shown in FIGS. 1 and 2, one embodiment of the means for moving the cylindrically-shaped element 5 is a moving assembly that includes a guide 9 supported in the apparatus, a platform 15 mounted for movement on the guide, and a finger 10 movably mounted on the platform and capable of engaging the element. The guide 9 is mounted in the apparatus adjacent the second supporting means 6 so that the guide is parallel or substantially parallel to a lengthwise axis of the second support means. The guide 9 may be fixed to an assembly of the arc 6 so that the guide moves together with the arc when elements of different repeat length are processed. One end of the platform 15 is mounted in or on a groove or rail 12 of the guide 9 so that the platform 15 is capable of linear movement, as indicated by arrow 13, along the guide 9. Mounted to the platform 15, opposite the end mounted on the guide 9, is the means for swivelling 7 the finger 10 into and out of engagement with a side of the element 5 between an "in" or engaged position **8*a* and an "out" or retracted position 8*b* (shown in phantom line). In one embodiment, the swivel mounted finger 10 is shaped such that in the engaged position 8*a* the finger contacts a side face or edge of the cylindrically-shaped element 5 to move the element along the axial length of the support member or support means. The finger 10 can be of any shape provided that when in the engaged position 8*a* the finger at least securely touches, and may sufficiently overlaps, with the side face of the cylindrical element 5. In an alternate embodiment (not shown), the finger may include a grip or clamp that actively engages the element by capturing the side edge of the element. In one embodiment of the engaged position 8*a*, the finger 10 has a leading end or tip that contacts the side face of the element 5 adjacent or close to the second support means 6. In another embodiment, the tip of the finger 10 contacts the side face of the element 5 and lightly contacts an outer (axial or lengthwise) edge of the arc 6, such that the tip can glide along the edge of the arc using the arc as an additional guide as the finger is moved by the platform. The movement of the platform 15 on the guide 9 and the means for swivelling 7 the finger 10 are controlled by a programmable logic controller (PLC) of the apparatus to allow for precise positioning of the element to a desired location on the axial length of the support means. In the embodiment shown, the guide 9 is positioned adjacent the second support means 6 having an arcuate shape, but is not so limited and in an alternate embodiment can be positioned adjacent the first support means 3**. In most embodiments, the desired location of the element is a position midway or about midway on the axial length of the support means and centered according to the width of the cylindrical element.

In one embodiment of the invention, the swivel mounted finger 10 has two fixed positions; the "in" or engaged position 8*a*, and the "out" or retracted position 8*b*. In the engaged position 8*a*, the finger 10 is in a position that contacts the side face of the cylindrical element 5 so that the element can be moved on the support means into the required position. The platform 15 moving on the guide 9 causes the finger 10 to push the element 5 into the desired axial position on the support means. In the retracted position 8*b*, the finger 10 is positioned so that it does not contact the cylindrical element 5. The finger 10 can be operated or swivelled from the retracted position 8*b* to the engaged position 8*a*, and vice versa, by any of several actuating means, such as for example by, a pneumatic cylinder, a motor, a magnet, and/or a hydraulic system. The movement of the finger 10 from one modus into the other is not dependent upon the size or type of cylindrical element.

One or more of the parameters of the cylindrically-shaped element, including the size of the element, such as its axial length and/or internal diameter, can be provided to the PLC by manually entering the size into a computer connected to the PLC, selecting from predetermined list of potential sizes of elements, and/or automatically detected by sensors appropriately positioned in the apparatus and connected to the PLC. Since the desired position of the element on the support means can be dependent upon axial length of the element, the PLC controls the movement of the platform 15 on the guide 9 to appropriately position the cylindrical element. The platform 15 can be driven on the guide 9 by any means including, for example, a motor, a pneumatic, or a hydraulic positioning system.

The operation of the process for positioning the cylindrical element is described relative to the embodiment shown in FIGS. 1 and 2. The process begins by moving the first supporting means 3 and/or the second supporting means 6 sufficiently close together so that the element 5 will encompass both the first and second support means when being mounted. In most embodiments, the first and second support means are sufficiently close when the distance between diametrically opposite exterior surfaces of the first and second support means is less than an interior diameter of the element. In embodiments of the apparatus having only one support means, it may be useful but not necessary to move the support means into position for loading of the element. An operator manually mounts the element into the apparatus by placing a first end 18 of the cylindrical element 5 about a first end 19 of both the first support means 3 and second support means 6 so that the element encompasses both the support means, and then slides the element along the axial length of the support means 6,3. The element 5 is slid to an intake position in which a second end 20 (i.e., an end opposite the first end) of the element approximately coincides with the first end 19 of the support means, that is, the side face of the element 5 opposite the first end 18 is aligned or adjacent the first end 19 of the arc. A sensor detects the presence of the cylindrically-shaped element 5 on the support means and informs the PLC, which determines the distance to move the platform 15 on the guide 9 that will position the element on the support to the desired location. The platform 15 with the finger 10 in the retracted position 8*b* travels on the guide 9 from a home position, which is typically opposite the first end of the support means 6, to the intake position where the finger swivels into the engaged position 8*a* touching the side face of the element. The platform 15 moves along the groove or rail 12 in the guide 9 away from the intake position causing the finger 10 to push the element 5 on the support means 6 to the desired position. As soon as the element has reached the desired position, the finger 10 swivels to the retracted position 8*b*, the platform 15 returns to the home position, and treating begins. After treatment, the positioning device can be used to return the element 5 to the intake position for unloading from the apparatus. From the home position, the platform 15 moves along the guide 9 to position the finger 10 adjacent the first end 18 of the element 5, the finger 10 swivels into the engaged position 8*a* contacting the side face of the first end 18 of the element 5, and the platform continues moving away from the home position pushing the element toward the intake position until the second end 20 of the element coincides with the first end 19 of the support means 6.

In an alternate embodiment, it is contemplated that the positioning device can continue to push the element for some predetermined distance after the second end of the element coincides with the first end of the support means to facilitate unloading of the element by the operator. In another embodiment, it is contemplated that the positioning device can be used to appropriately position two or more elements adjacent to each other on the support means. In this case the first element is placed in the intake position and then further moved in with the second element when placing the second element in the intake position. Both elements are now in close contact at their edges. For intake both elements are treated as one element with the sum of widths and centered accordingly. After the treating step, both elements are moved to the intake position so that the first element can be removed. After that the positioning means can be activated again to move the second element to the intake position for removal.

The apparatus also includes a means for treating an exterior surface of the element opposite the interior surface. In one embodiment, the cylindrically-shaped element is a support, and the apparatus is useful for treating the cylindrically-shaped element by forming a layer or modifying an existing layer on an exterior surface of the support to create a cylindrically-shaped printing form. The apparatus is capable of forming a layer of a photosensitive composition or other functional layer on the exterior surface of the cylindrical support by suitable means including, but not limited to, laminating, extruding, calendering, and coating, to generate a cylindrically-shaped printing form in an uncured or raw state. The uncured cylindrically-shaped printing form can then undergo any of various processes, e.g., imagewise expose, wet or dry development, to form a printing form having a relief surface. In another embodiment, the apparatus is useful for treating a cylindrically-shaped element that includes a photosensitive layer by thermally developing the element to create a relief structure suitable for printing as a flexographic printing form to form a relief surface in the element. The apparatus is capable of heating the photosensitive element having a layer of composition capable of being partially liquefied to a temperature sufficient to melt or soften or liquefy at least a portion of the layer for any purpose.

Treating by Thermal Development

Following imagewise exposure to actinic radiation the photosensitive element is thermally treated to remove unpolymerized areas in the photopolymerizable layer and thereby form a relief image. The thermal treating step removes at least the photopolymerizable layer in the areas that were not exposed to actinic radiation, i.e., the unexposed areas or uncured areas, of the photopolymerizable layer.

Treating the element thermally includes heating the photosensitive element having at least one composition layer, that is at least one photopolymerizable layer, (and optionally additional layer/s) to a temperature sufficient to cause the uncured portions of the photopolymerizable layer to soften or melt or flow. The exterior surface of the composition layer of the photosensitive element is heated to a temperature sufficient to cause a portion of the layer to liquefy. The thermal development process is conducted typically with more than one cycle of heating the element and contacting the element with the development medium in order to remove the uncured polymer to a suitable relief depth because uncured portions of the composition layer may only partially liquefy upon heating. In a preferred embodiment, treating also includes contacting an outermost surface of the element to an absorbent surface to absorb or wick away the melt or flow portions. The polymerized areas of the photopolymerizable layer have a higher melting temperature than the unpolymerized areas and therefore do not melt, soften, or flow at the thermal development temperatures. Thermal development of photosensitive elements to form flexographic printing plates is described, for example, by Martens in U.S. Pat. Nos. 5,015,556; 5,175,072; 5,215,859; and by Wang et al. in WO 98/13730.

The thermal treating steps of heating the photosensitive element and contacting an outermost surface of the element with development medium can be done at the same time, or in sequence provided that the uncured portions of the photopolymerizable layer are still soft or in a melt state when contacted with the development medium. The at least one photopolymerizable layer (and optionally additional layer/s) are heated by conduction, convection, radiation, or other heating methods to a temperature sufficient to effect melting of the uncured portions but not so high as to effect distortion of the cured portions of the layer. The photosensitive element is heated to a surface temperature above about 40° C., preferably from about 40° C. to about 230° C. (104-446° F.) in order to effect melting or flowing of the uncured portions of the photopolymerizable layer. By maintaining more or less intimate contact of the development medium with the photopolymerizable layer that is molten in the uncured regions, a transfer of the uncured photosensitive material from the photopolymerizable layer to the development medium takes place. While still in the heated condition, the development medium is separated from the cured photopolymerizable layer in contact with the support layer to reveal the relief structure. A cycle of the steps of heating the photopolymerizable layer and contacting the molten (portions) layer with an absorbent material can be repeated as many times as necessary to adequately remove the uncured material and create sufficient relief depth. However, it is desirable to minimize the number of cycles for suitable system performance, and typically the photopolymerizable element is thermally treated for 5 to 15 cycles. Intimate contact of the development medium to the photopolymerizable layer (while the uncured portions are melt) may be maintained by pressing the layer and the development medium together.

The development medium is selected having a melt temperature exceeding the melt temperature of the uncured portions of the photopolymerizable layer and having good tear resistance at the same operating temperatures. Preferably, the selected material withstands the temperatures required to process the photosensitive element during heating. The development medium is selected from non-woven materials, paper stocks, fibrous woven material, open-celled foam materials, porous materials that contain more or less a substantial fraction of their included volume as void volume. The development medium can be in web or sheet form. The development medium should also possess a high absorbency for the molten elastomeric composition as measured by milligrams of elastomeric composition that can be absorbed per square centimeter of the development medium. Preferred is a non-woven web.

Cylindrically-Shaped Element

The cylindrically-shaped element to be positioned by the moving device in the apparatus has an association with a cylindrical shape or substantially cylindrical shape. Cylindrically-shaped element encompasses cylindrical elements having one or more photosensitive layers pre-existing on the element, and cylindrical elements without a photosensitive layer, such as a support or sleeve. In one embodiment, the cylindrically-shaped element may only be a support or a sleeve, and the apparatus prepares a cylindrical photosensitive element by treating the sleeve support to include one or more layers on the sleeve support. In another embodiment, the cylindrically-shaped element may be a cylindrical photosensitive element as described in the following embodiments, which undergoes thermal treatment to make a printing form having a relief surface. The support for the element itself may be cylindrical, or the element may be grouped with at least one other structure that is cylindrically shaped. Since in one embodiment the resulting printing form is ultimately mounted onto a printing cylinder, the shape of the support or structure is generally cylindrical. However, the element may not be cylindrical or may only be substantially cylindrically shaped while in operative engagement in the present apparatus and process or when not mounted onto the printing cylinder. The element may include a continuous, seamless or substantially seamless, photopolymerizable composition layer adjacent to or on the cylindrically-shaped support. The element can also encompass plate-on-sleeve system. Typically, plate-on-sleeve is a cylindrically-shaped element that includes at least the composition layer on a planar support, i.e., a plate, which is then mounted onto a cylindrically-shaped support. Ends of the plate may or may not meet or join when wrapped onto the sleeve. Plate-on-sleeve also includes an embodiment in which more than one plate, or portions of plates, are mounted onto a sleeve at various spaced locations. Also contemplated as the element is a photosensitive plate having at least one photopolymerizable composition layer preferably on a base support, which is formed into a cylinder by butt joining both edges. The plate edges can be joined by any method including, but not limited to, melt fusing, taping, stitching, clamping, stapling, taping, gluing, and sewing. In this embodiment the base support would become the cylindrical support. Any of the embodiments that include the photosensitive layer as described above may be referred to as cylindrical printing elements or cylindrical printing forms. The cylindrical printing form has an interior surface having an interior diameter and an interior circumference (i.e., the perimeter of the interior surface). In one embodiment, the printing element has been image-wise exposed to actinic radiation thereby polymerizing the photosensitive composition layer in the exposed areas.

What is claimed is:

1. An apparatus for treating a cylindrical element having a first side edge and a side edge opposite the first side edge, comprising:

means for supporting the cylindrical element adapted to contact a first part of an interior circumferential surface of the cylindrical element without firmly fixing the cylindrical element to the means for supporting, the supporting means having an axial length;

means for moving the cylindrical element axially along the axial length of the supporting means comprising a finger mounted on a guide for linear movement in a first direction and in a second direction opposite the first direction and configured to travel along a length of the guide to contact independently the first side edge and the opposite side edge of the cylindrical element, wherein the finger contacts the first side edge of the cylindrical element and moves on the guide in the first direction to thereby move the cylindrical element in the first direction from a first position to a second position, and selectively, the finger contacts the opposite side edge of the cylindrical element to thereby move the cylindrical element in the second direction from the second position to the first position; and, means for thermally treating the cylindrically-shaped element to create a relief structure suitable for printing.

2. The apparatus of claim 1 wherein the guide is adjacent to and parallels the means for supporting.

3. The apparatus of claim 2 wherein the means for moving further comprises means for swivelling the finger into and out of engagement with the cylindrical element.

4. The apparatus of claim 2, further comprising means for actuating the linear movement on the guide selected from a group consisting of pneumatic cylinder, motor, magnet and hydraulic system.

5. The apparatus of claim 1 further comprising a means for determining an axial position of the cylindrical element on the means for supporting.

6. The apparatus of claim 1 wherein the supporting means is selected from the group consisting of a drum, a roller, a plurality of rollers, and a platform member.

7. The apparatus of claim 1 further comprising a second means for supporting the element by contacting a second part of the interior surface different from the first part, wherein the element has one or more unsupported parts between the first part and the second part.

8. The apparatus of claim 1 wherein the means for thermally treating comprises means for heating an exterior surface of the element opposite the interior surface, and means for contacting the element with a development medium to form the relief structure.

9. A process for treating a cylindrical element having an interior surface and a first side face and a side face opposite the first side face, comprising:

supporting the cylindrical element by contacting a first part of an interior circumferential surface of the cylindrical element on a support member without firmly fixing the cylindrical element to the support member, the support member having an axial length;

moving the cylindrical element axially along the axial length of the supporting means with a finger that moves linearly on a guide in a first direction and in a second direction opposite the first direction and is configured to travel along a length of the guide to contact independently the first side face and the opposite side face of the cylindrical element, by contacting the finger to the first side face of the cylindrical element and moving the finger on the guide in the first direction to thereby move the cylindrical element from a first position to a second position, or by contacting the finger to the opposite side face of the cylindrical element and moving the finger on the guide in the second direction to thereby move the cylindrical element from the second position to the first position; and thermally treating the cylindrical element to create a relief structure suitable for printing.

10. The process of claim 9 further comprising swivelling the finger into and out of contact with the side face.

11. The process of claim 9 wherein the moving step comprises actuating the finger for linear movement on the guide.

12. The process of claim 9 further comprising determining the second position on the support member.

13. The process of claim 9 further comprising determining an axial length of the element and determining the second position on the support member based on the axial length of the element.

14. The process of claim 9 further comprising supporting an interior surface of a second cylindrical element having a first side face and a second side face opposite the first side face on the support member without firmly fixing the second cylindrical element to the support member, moving the second cylindrical element axially along the axial length of the support member with the finger by engaging the finger into contact with the first side face of the second element and moving the finger on the guide in the first direction to thereby move the second element from the first position to another position different from the second position on the support member.

15. The process of claim 9 wherein the cylindrical element comprises a photosensitive element having a layer of composition capable of being partially liquefied on a support, and thermally treating comprises heating an exterior surface of the element opposite the interior surface, and contacting the element with a development medium to form the relief structure.

16. A thermal treating apparatus for thermally developing a cylindrical photosensitive printing element having a first side edge and a side edge opposite the first side edge, comprising a device for positioning the cylindrical element in the apparatus, the positioning device comprising:

a support member for supporting the cylindrical element in contact with a first part of an interior circumferential surface of the cylindrical element without firmly fixing the cylindrical element to the support member, the support member having an axial length; and adjacent the support member, a finger mounted for linear movement on a guide in a first direction and in a second direction opposite the first direction and configured to travel along a length of the guide to contact independently the first side face and the opposite side face of the cylindrical element, wherein the finger positions the cylindrical element axially on the support member by contacting the first side edge of the cylindrical element and moving in the first direction to thereby move the cylindrical element in the first direction from a first position to a second position, and selectively by contacting the opposite side edge of the cylindrical element and moving in the second direction to thereby move the cylindrical element in the second direction from the second position to the first position.

* * * * *